US008039190B2

(12) United States Patent
Tabira et al.

(10) Patent No.: US 8,039,190 B2
(45) Date of Patent: Oct. 18, 2011

(54) CARRIER CORE MATERIAL FOR ELECTROPHOTOGRAPHIC DEVELOPER, CARRIER, AND ELECTROPHOTOGRAPHIC DEVELOPER USING THE CARRIER

(75) Inventors: Yasunori Tabira, Saitama (JP); Koji Aga, Kashiwa (JP); Tomoyuki Suwa, Nagareyama (JP)

(73) Assignees: Mitsui Mining & Smelting Co., Ltd., Tokyo (JP); Powdertech Co., Ltd., Chiba (JP)

( * ) Notice: Subject to any disclaimer, the term of this patent is extended or adjusted under 35 U.S.C. 154(b) by 456 days.

(21) Appl. No.: 12/399,129

(22) Filed: Mar. 6, 2009

(65) Prior Publication Data

US 2009/0246676 A1 Oct. 1, 2009

(30) Foreign Application Priority Data

Mar. 31, 2008 (JP) ..... 2008-090650

(51) Int. Cl.
*G03G 9/00* (2006.01)

(52) U.S. Cl. ..... 430/111.33; 430/111.3; 430/111.31

(58) Field of Classification Search ..... 430/108.1, 430/111.1, 111.3, 111.31, 111.33, 111.35
See application file for complete search history.

(56) References Cited

U.S. PATENT DOCUMENTS 5,466,552 A 11/1995 Sato et al.
7,862,975 B2 * 1/2011 Tabira et al. ..... 430/111.33
2004/0229151 A1 * 11/2004 Kobayashi et al. ..... 430/111.32
2007/0243479 A1 * 10/2007 Yoshihara et al. ..... 430/110.3
2009/0246677 A1 * 10/2009 Tabira et al. ..... 430/111.33

FOREIGN PATENT DOCUMENTS

JP 7-333910 12/1995
JP 9-6052 1/1997
JP 2007-333886 12/1997
JP 9-236945 9/2009

OTHER PUBLICATIONS

U.S. Appl. No. 12/399,164, filed Mar. 6, 2009, and entitled "Carrier Core Material for Electrophotographic Developer, Carrier, and Electrophotographic Developer Using The Carrier".

* cited by examiner

*Primary Examiner* — Christopher Rodee
*Assistant Examiner* — Stewart Fraser
(74) *Attorney, Agent, or Firm* — Greenblum & Bernstein, PLC

(57) ABSTRACT

A carrier core material for an electrophotographic developer including Li ferrite, maghemite, and $Fe_3O_4$, wherein a part thereof is substituted with Mn, Li content is 1 to 2.5% by weight, Mn content is 2 to 7.5% by weight, and silicon content is 25 to 10,000 ppm, the following equation (1) is satisfied when respective integrated strengths of spinel crystal structure (110), (210), (211), and (311) faces in X-ray diffraction are respectively $I_{110}$, $I_{210}$, $I_{211}$, and $I_{311}$, a resistivity $R_{50}$ of 50 V across a 6.5 mm gap is $5\times10^7$ to $7\times10^8\Omega$, and a resistivity $R_{1000}$ of 1,000 V across a 6.5 mm gap is $1\times10^7$ to $8\times10^8\Omega$.

$$2<100\times(I_{110}+I_{210}+I_{211})/I_{311}<14 \quad (1).$$

8 Claims, 1 Drawing Sheet

CARRIER CORE MATERIAL FOR ELECTROPHOTOGRAPHIC DEVELOPER, CARRIER, AND ELECTROPHOTOGRAPHIC DEVELOPER USING THE CARRIER

BACKGROUND OF THE INVENTION

1. Field of the Invention

The present invention relates to a carrier core material for an electrophotographic developer, a carrier, and an electrophotographic developer using the carrier, in a two-component electrophotographic developer used in copiers, printers and the like.

2. Description of the Related Art

Two-component electrophotographic developers used in electrophotographic methods are formed from a toner and a carrier. The carrier acts as a carrier substance that is mixed with the toner by stirring in a developing box to impart a desired charge to the toner and transport the charged toner to the surface of a photoreceptor to form an electrostatic latent image. Carrier remaining on the developing roll which is supported by magnets after forming the toner image returns back into the developing box, and is then mixed and stirred with new toner particles for reuse over a certain time period.

Unlike one-component electrophotographic developers, for these two-component electrophotographic developers, the carrier is stirred with the toner particles to impart desired charge properties to the toner particles and has a function of transporting the toner, and controllability in developer design is good. Therefore, two-component electrophotographic developers are especially widely used in full color developing machines for which high image quality is demanded and in high-speed machines for which the reliability and durability of image sustainability are demanded.

In such a two-component electrophotographic developer, to obtain high image quality, ferrite particles, such as Cu—Zn ferrite and Ni—Zn ferrite, may be used as a carrier instead of oxide-coated iron powder and resin-coated iron powder. Ferrite carriers using such ferrite particles have many advantageous properties for obtaining high image quality, such as usually being more spherical than conventional iron powder carriers and having adjustable magnetic properties. Further, a resin-coated ferrite carrier which has such ferrite particles as a core material and is coated with various resins, has improved abrasion resistivity, durability and the like, and has an adjustable volume specific resistivity.

However, recently, environmental regulations have become more strict, and the use of metals such as Ni, Cu, and Zn is now avoided. Thus, there is a need to use metals which comply with the environmental regulations.

Examples of uses of metals which comply with the environmental regulations include the conventionally-used iron powder carriers and magnetite carriers. However, with these carriers, it is difficult to obtain the image quality and life of the above-described ferrite carriers.

As a ferrite which complies with the environmental regulations, Li—Mn ferrite has been proposed. However, it is pointed out that Li is easily affected by the surrounding environment, such as temperature and humidity, so that its properties greatly change.

Japanese Patent Laid-Open No. 7-333910 discloses a ferrite carrier for an electrophotographic developer wherein a part of the Li ferrite is substituted with at least one selected from the group consisting of alkaline earth metal oxides. Specific examples thereof are mentioned in the examples as Li—Mg ferrite carriers and Li—Mg—Ca ferrite carriers. This Japanese Patent Laid-Open No. 7-333910 describes that a carrier for an electrophotographic developer can be obtained which can maintain durability equal to or better than conventional ferrite particles, and which has excellent stability against the surrounding environment. However, this carrier for an electrophotographic developer suffers from the problem of having low scattered matter magnetization due to sintering unevenness.

In Comparative Examples 7, 12, and 17 of Japanese Patent Laid-Open No. 7-333910, a Li—Mn ferrite carrier is described. These Comparative Examples 7, 12, and 17 are described as having a large changes in charge amount under environmental fluctuation, and a large amount of scattered matter.

Japanese Patent Laid-Open No. 9-6052 describes a ferrite carrier for an electrophotograph which includes a fixed amount of $V_2O_5$ and $Bi_2O_3$ in Li ferrite and Li—Mn ferrite, whereby abnormal crystal particle growth is suppressed, and as a result, there is little toner contamination and a long life is obtained.

Sample No. 8 of Japanese Patent Laid-Open No. 9-6052 describes a Li—Mn ferrite carrier, in which contamination from the toner resulting from changes in the charge amount occurs.

Japanese Patent Laid-Open No. 9-236945 describes a two-component developer formed from a Li—Mn ferrite carrier, which is coated with resin on its surface and which has a specific volume specific resistivity, and a specific toner, wherein a high quality image can be obtained which is stable for a long period of time.

However, such Li—Mn ferrite carriers suffer from the problem that usually resistivity is high, and that resistivity is reliant on electric field strength. In carriers for an electrophotographic developer, just having a resistivity in a specific electric field strength in a specific range is insufficient. While developing bias changes in development which employs electrophotography, a resistivity is required which constantly ensures that no carrier beads carry over occurs even if the developing bias changes. Moreover, it is preferred to obtain an image density which is stable even if the developing bias changes. For this reason, it is necessary to ensure that there are no large changes in resistivity between low bias and high bias.

SUMMARY OF THE INVENTION

Therefore, it is an object of the present invention to provide a carrier core material for an electrophotographic developer which does not have large changes in resistivity from low bias to high bias, in which a result of having controllable magnetization does not cause carrier beads carry over to occur, and which can obtain a stable image density, a carrier, and an electrophotographic developer using the carrier.

As a result of investigation, the present inventors discovered that the above object could be achieved by a carrier core material, a carrier formed by coating a resin in such carrier core material, and an electrophotographic developer using such carrier, the carrier having constituent elements of Li, Mn, Fe, and O, and further containing a small amount of silicon, respective integrated strengths ratios of specific faces in X-ray diffraction in a fixed relationship, and a 50 V resistivity and a 1,000 V resistivity across a 6.5 m gap in specific ranges, thereby arriving at the present invention. Further, the present inventors discovered that a carrier core material such as that described above can be produced, not in air, but by sintering in an atmosphere having a controlled oxygen concentration.

Specifically, the present invention provides a carrier core material for an electrophotographic developer including Li ferrite, maghemite ($\gamma$-$Fe_2O_3$), and $Fe_3O_4$, wherein a part thereof is substituted with Mn, Li content is 1 to 2.5% by weight, Mn content is 2 to 7.5% by weight, and silicon content is 25 to 10,000 ppm, the following equation (1) is satisfied when respective integrated strengths of spinel crystal structure (110), (210), (211), and (311) faces in X-ray diffraction are respectively $I_{110}$, $I_{210}$, $I_{211}$, and $I_{311}$, a resistivity $R_{50}$ of 50 V across a 6.5 mm gap is $5\times10^7$ to $7\times10^8\Omega$, and a resistivity $R_{1000}$ of 1,000 V across a 6.5 mm gap is $1\times10^7$ to $8\times10^8\Omega$.

$$2<100\times(I_{110}+I_{210}+I_{211})/I_{311}<14 \quad (1)$$

The carrier core material for an electrophotographic developer according to the present invention preferably has a BET specific surface area of 0.075 to 0.3 $m^2/g$.

The carrier core material for an electrophotographic developer according to the present invention preferably has magnetization at $3K\cdot1000/4\pi\cdot A/m$ (3 KOe) of 40 to 71 $Am^2/kg$.

The carrier core material for an electrophotographic developer according to the present invention preferably has a volume average particle size of 20 to 100 μm.

Further, the present invention provides a carrier for an electrophotographic developer, which is formed by coating a resin in the above-described carrier core materials.

In the carrier for an electrophotographic developer according to the present invention, the resin is preferably one kind or more selected from the group consisting of a silicone resin, an acrylic-modified silicone resin, a fluorine-modified silicone resin, an acrylic resin, and a fluorine acrylic epoxy resin.

The carrier for an electrophotographic developer according to the present invention preferably includes in the resin at least one kind of inorganic microparticles selected from the group consisting of carbon black, a metal oxide, and a metal complex.

Further, the present invention provides an electrophotographic developer composed of the above-described carrier and a toner.

By using the carrier core material and the carrier according to the present invention, the electrophotographic developer does not have large changes in resistivity from low bias to high bias and, as a result of having controllable magnetization, carrier beads carry over does not occur and a stable image density can be obtained.

DETAILED DESCRIPTION OF THE PREFERRED EMBODIMENTS

Figure 1:
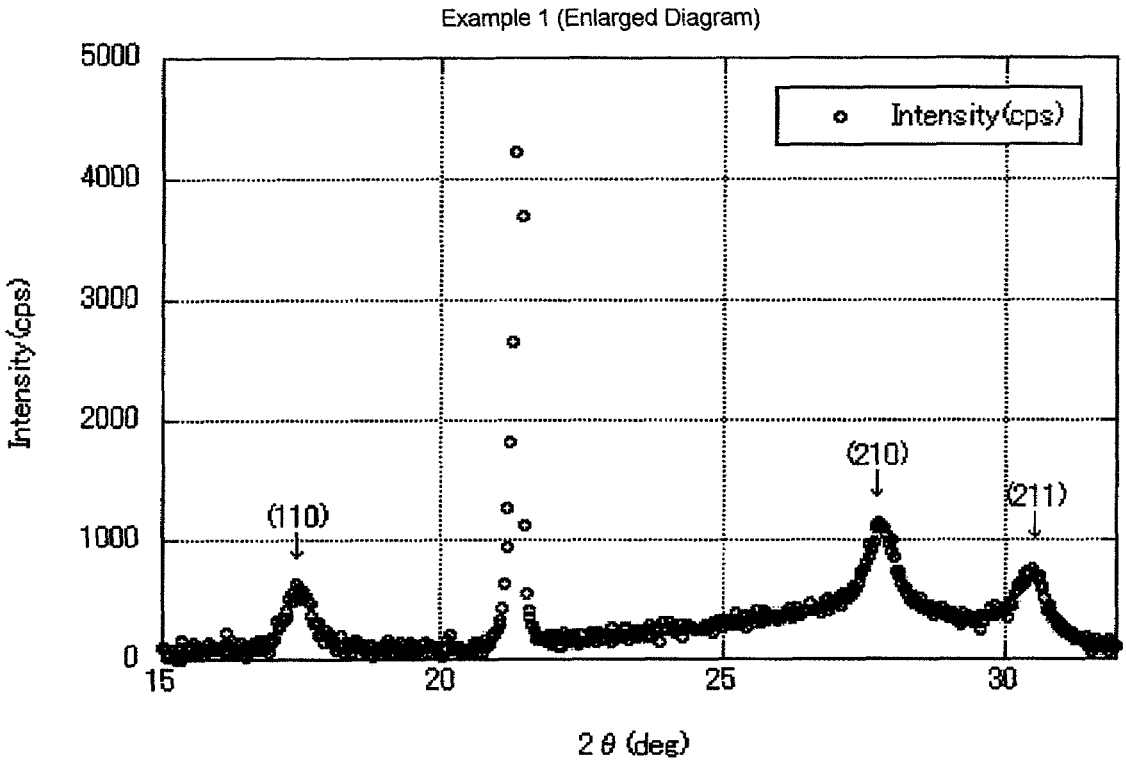
FIG. 1 illustrates an enlarged X-ray diffraction chart of the (110), (210), and (211) vicinity of the carrier core material particles obtained in Example 1.

Preferred embodiments for carrying out the present invention will now be described.

<Carrier Core Material for Electrophotographic Developer According to the Present Invention>

The carrier core material according to the present invention is formed from Li ferrite, maghemite ($\gamma$-$Fe_2O_3$), and $Fe_3O_4$, and a part thereof is substituted with Mn. Here, the Li content is 1 to 2.5% by weight and the Mn content is 2 to 7.5% by weight. Thus, by including Li, magnetization can be reduced, and by including Mn, magnetization can be increased. Therefore, the magnetization can be controlled by selecting the Li and Mn contents according to the application.

If the Li content is less than 1% by weight, the effects of including Li are not exhibited, and the same as with maghemite and Mn ferrite, resistivity becomes too low, so that the desired image quality may not be obtained. If the Li content is more than 2.5% by weight, the environmental dependency of the charge amount deteriorates, so that the desired charge properties may not be obtained. Further, if the Mn content is less than 2% by weight, the effects of including Mn are not obtained, so that the desired magnetic properties may not be obtained. If the Mn content is more than 7.5% by weight, excess iron and Mn which did not turn into ferrite even after the sintering form other compounds so that a red fine powder is produced, which can become a factor in image defects such as white spots.

The carrier core material for an electrophotographic developer according to the present invention has a silicon content of 25 to 10,000 ppm, preferably 50 to 10,000 ppm, and more preferably 100 to 10,000 ppm. By including a small amount of silicon in this manner, the strength of the carrier core material improves. If the silicon content is less than 25 ppm, the effects of including silicon are not exhibited, while if the silicon content is more than 10,000 ppm, the sintering proceeds too far for the same temperature, so that the carrier may have a poor shape.

The carrier core material for an electrophotographic developer according to the present invention satisfies the following equation (1) when the respective integrated strengths of the spinel crystal structure (110), (210), (211), and (311) faces in X-ray diffraction are respectively $I_{110}$, $I_{210}$, $I_{211}$, and $I_{311}$.

$$2<100\times(I_{110}+I_{210}+I_{211})/I_{311}<14 \quad (1)$$

As illustrated in equation (1), the lower limit of $100\times(I_{110}+I_{210}+I_{231})/I_{311}$ is more than 2, and the upper limit is less than 14. However, preferred is more than 2 to 10, and still more preferred is more than 2 to 6.

As is described later, in Li—Mn ferrite, the oxidation degree of the Li—Mn ferrite can be known based on the integrated strengths of specific peaks which are contained in a pattern measured by X-ray diffraction. Specifically, for ferrite which originally has an almost completely spinel structure, peaks attributable to the (110), (210), and (211) faces are not detected by X-ray diffraction. However, because lattice defects are formed in parts of the spinel structure due to sintering under an oxidizing atmosphere, a new periodicity similar to maghemite is produced, and the level of lattice defects is reflected in the magnitude of the peaks attributable to the (110), (210), and (211) faces. Thus, by comparing the sum of the integrated strengths of these three peaks with the integrated strengths of the peaks which consistently appears in a spinel structure, the degree of oxidation of the L-Mn ferrite can be quantitatively known. It is noted that Li atoms have a small atomic weight, are not easily X-ray diffracted and a diffraction pattern similar to that of maghemite is obtained for Li atoms. Therefore, the structures similar to Li ferrite described in the present specification include structures in which a part of the Li ferrite is substituted with Mn, maghemite, and structures in which a part of the maghemite is substituted with Mn, and also the raw material Mn compound is not present in the carrier core material in the form of the raw material or as a standalone Mn oxide (MnO, $Mn_2O_3$, and $Mn_3O_4$).

In equation (1), when $100\times(I_{110}+I_{210}+I_{211})/I_{311}$ is 2 or less, the amount of crystal structures similar to maghemite is relatively decreased, while the amount of magnetite partially substituted with Mn having an ordinary spinel structure increases. This means that electrical resistivity decreases and magnetization increases. If $100\times(I_{110}+I_{210}+I_{211})/I_{311}$ is 14 or more, maghemite substituted with Mn and Li ferrite partially substituted with Mn having a diffraction pattern similar to maghemite are mainly produced. This means that not only do lattice defects in the crystal lattice increase, but also that electrical resistivity increases and magnetization decreases due to the defects themselves being regularly arranged.

The carrier core material for an electrophotographic developer according to the present invention has a resistivity $R_{50}$ of 50 V across a 6.5 mm gap of $5\times10^7$ to $7\times10^8\Omega$, and a resistivity $R_{1000}$ of 1,000 V across a 6.5 mm gap of $1\times10^7$ to $8\times10^8\Omega$. If the 50 V and 1,000 V resistivities across a 6.5 mm gap are beyond these ranges, a large change in resistivity from low bias to high bias is caused, and the electric field dependence of the resistivity increases.

The BET specific surface area of the carrier core material for an electrophotographic developer according to the present invention is preferably 0.075 to 0.30 $m^2/g$, more preferably 0.075 to 0.25 $m^2/g$, and most preferably 0.075 to 0.20 $m^2/g$. If the BET specific surface area is less than 0.075 $m^2/g$, this means that the surface is scarcely irregular. As a result, when a resin is coated and the resultant product is used as a carrier in an actual machine, the anchor effects of the resin due to the irregularity, so that the coated resin may peel off. If the BET specific surface area is more than 0.30 $m^2/g$, the surface area is too large, so that the charge properties may deteriorate due to the adsorption of moisture in the air onto the carrier surface.

The magnetization at $3K\cdot1000/4\pi\cdot A/m$ of the carrier core material for an electrophotographic developer according to the present invention is preferably 40 to 71 $Am^2/g$, more preferably 45 to 71 $Am^2/g$, and most preferably 50 to 71 $Am^2/g$. If the magnetization at $3K\cdot1000/4\pi\cdot A/m$ is less than 40 $Am^2/g$, scattered matter magnetization deteriorates, which can become a factor in image defects caused by carrier beads carry over. If the magnetization at $3K\cdot1000/4\pi\cdot A/m$ is more than 71 $Am^2/g$, the amount of Li ferrite among the composition included in the carrier core material decreases and the amount of magnetite, maghemite, and Mn ferrite relatively increases, which can result in the resistivity becoming too low. This can become a factor in carrier beads carry over due to low resistivity.

The volume average particle size of the carrier core material for an electrophotographic developer according to the present invention is preferably 20 to 100 μm, more preferably 20 to 80 μm, and most preferably 20 to 60 μm. In this range, carrier beads carry over is prevented, and good image quality can be obtained. If the volume average particle size is less than 20 μm, carrier beads carry over tends to occur, and thus is not preferable, while if the volume average particle size is more than 100 μm, image quality tends to deteriorate, and thus is not preferable.

The properties etc. of these carrier core materials were measured as follows.

(Li, Mn, Fe, and Silicon Contents)

An aqueous solution in which the carrier core material was completely dissolved was prepared by weighing 0.2 g of the carrier core material, charging 60 mL of pure water, 20 mL of 1 mol/L hydrochloric acid, and 20 mL of 1 mol/L nitric acid thereto, and then heating. The Li, Mn, Fe, and silicon contents were measured using an ICP analysis apparatus (manufactured by Shimadzu Corporation, ICPS-1000IV).

(Resistivity)

Non-magnetic parallel plate electrodes (10 mm×40 mm) are made to face each other with an inter-electrode interval of 6.5 mm. 200 mg of a sample is weighed and filled between the electrodes. The sample is held between the electrodes by attaching a magnet (surface magnetic flux density: 1500 Gauss, surface area of the magnet in contact with the electrodes: 10 mm×30 mm) to the parallel plate electrodes, and 50 V and 1,000 V voltages are applied in order. The resistivity for the respective applied voltages was measured by an insulation resistivity tester (SM-8210, manufactured by DKK-TOA Corporation). Measurement was carried out in a constant temperature, constant humidity room controlled at a room temperature of 25° C. and a humidity of 55%.

(BET Specific Surface Area)

Using the Automatic Specific Surface Area Analyzer Gemini 2360 (manufactured by Shimadzu Corporation), the BET specific surface area can be determined from the $N_2$ adsorbed amount of the carrier particles measured by adsorbing the adsorption gas $N_2$. In the present invention, the measurement tube used when measuring this $N_2$ adsorbed amount was, prior to measurement, air baked for 2 hours at 50° C. under a reduced pressure state. Further, after filling this measurement tube with 5 g of the carrier core material particles and pre-treating for 2 hours at 30° C. under a reduced pressure state, the $N_2$ gas was adsorbed at 25° C., and that adsorbed amount was measured. These adsorbed amounts were the values obtained by plotting an adsorption isotherm, and calculating from the BET equation.

(Magnetization)

Magnetization was measured using an integral-type B-H tracer BHU-60 (manufactured by Riken Denshi Co., Ltd.). An H coil for measuring magnetic field and a 4 πI coil for measuring magnetization were placed in between electromagnets. In this case, the sample was put in the 4 πI coil. The outputs of the H coil and the 4 πI coil when the magnetic field H was changed by changing the current of the electromagnets were each integrated; and with the H output as the X-axis and the 4 πI coil output as the Y-axis, a hysteresis loop was drawn on recording paper. The measuring conditions were a sample filling quantity of about 1 g, the sample filling cell had an inner diameter of 7 mm±0.02 mm and a height of 10 mm±0.1 mm, and the 4 πI coil had a winding number of 30.

(Volume Average Particle Size)

The volume average particle size was measured using the Microtrac Particle Size Analyzer (Model 9320-X100) manufactured by Nikkiso Co., Ltd. Water was used for the dispersion medium.

(Shape Factor: SF-1)

Using a JSM-6060A manufactured by JEOL Ltd., with an accelerating voltage of 20 kV, and a carrier SEM set at a 200 times view, the particles were photographed by dispersing them so that they did not overlap each other. This image information was fed via an interface into image analyzing software (Image-Pro PLUS) produced by Media Cybernetics Inc. for analysis to determine the area (surface area) and the Fere diameter (maximum). The shape factor SF-1 was the value obtained by calculating according to the following equation. The closer the carrier shape is to a sphere, the closer the value is to 100. The shape factor SF-1 was found by performing a calculation for each particle, and taking the average value of 100 particles of the carrier.

$$SF\text{-}1=(R^2/S)\times(\pi/4)\times100$$

R: Fere diameter (maximum), S: Area (surface area)

(Red Fine Particles)

10 g of the carrier core material was weighed and placed in a 50 mL glass bottle. 30 mL of ethanol was charged thereto, and the resultant mixture was hand shaken 20 times. The glass bottle was then laid to rest. One minute later, it was visually observed whether the ethanol supernatant had colored. If it had colored, red fine particles were determined to have been formed.

(X-Ray Diffraction Measurement)

The "X'Pert Pro MPD" manufactured by PANanalytical was used as the measurement apparatus. A Co tube (Co Kα rays) was used for the X-ray source, and collimating optics were used for the optical system. Measurement was carried out with 0.02° step scans. The measurement results data were processed using the analyzing software "X'Pert HighScore" in the same manner as for normal powder crystal structure analysis to determine the integrated strengths ratio. It is noted that while measurement could be carried out without any problems with a Cu tube for the X-ray source, for samples containing a large amount of Fe, since background noise increases compared with the peaks of the measurement target, it is preferred to use a Co tube. Further, while the same results might be obtained with a focus method for the optical system, since the measurement accuracy can deteriorate due to the occurrence of peak shift for samples having a large particle size, measurement with collimating optics is preferred. Further, measurement was carried out so that the count time at each point of the step scan had a spinel structure (311) face peak strength of about 50,000 cps, and so that there was no orientation towards a specific preferential direction of the particles.

(Carrier for an Electrophotographic Developer According to the Present Invention)

The carrier for an electrophotographic developer according to the present invention is formed by coating a resin on the carrier core material according to the present invention.

The coated resin used on the carrier for an electrophotographic developer according to the present invention is not especially limited, but is preferably one or more kinds of resin selected from the group consisting of a silicone resin, an acrylic-modified silicone resin, a fluorine-modified silicone resin, an acrylic resin, and a fluorine acrylic epoxy resin. The resin coated amount is preferably 0.5 to 3.0% by weight based on the carrier core material.

Further, to control the electrical resistivity, charge amount, and charge speed of the carrier, it is preferred to include in the resin at least one kind of inorganic microparticles selected from the group consisting of carbon black, a metal oxide, and a metal complex. Since the electrical resistivity of the inorganic microparticles themselves is low, there is a tendency for a sudden charge leak to occur if the included amount is too large. Therefore, the included amount is 0.25 to 20.0% by weight, preferably 0.5 to 15.0% by weight and especially preferably 1.0 to 10.0% by weight, of the solid content of the coated resin.

Further, in the coated resin, a charge control agent can be contained. Examples of the charge control agent include various charge control agents generally used for toners and various silane coupling agents. This is because, although the charging capability is sometimes reduced if a large amount of resin is coated, it can be controlled by adding the charge control agent or the silane coupling agent. The various charge control agents and coupling agents which may be used are not especially limited. Preferable examples of the charge control agent include a nigrosin dye, quaternary ammonium salt, organic metal complex and metal-containing monoazo dye. Preferable examples of the silane coupling agent include an aminosilane coupling agent.

<Carrier Core Material for an Electrophotographic Developer and Carrier Production Method According to the Present Invention>

Next, the carrier core material for an electrophotograph and carrier production method according to the present invention will be described.

First, to obtain a given composition, the carrier core raw materials are weighed, and then crushed and mixed by a ball mill, vibration mill or the like for 0.5 hours or more, and preferably for 1 to 20 hours. The resultant crushed material is pelletized by a pressure molding machine or the like, and calcined at a temperature of 900 to 1,200° C. If the calcining temperature is less than 900° C., the shape of the carrier surface after sintering becomes bumpy, while if the calcining temperature is more than 1,200° C., the crushing is difficult. This may also be carried out without using a pressure molding machine, by after the crushing adding water to form a slurry, and then granulating using a spray drier.

The calcined material is further crushed by a ball mill, vibration mill or the like, and then charged with an appropriate amount of water, and optionally with a dispersant, a binder or the like to form a slurry. After viscosity has been adjusted, the slurry is granulated using a spray drier. The resultant granules are held at a temperature of 1,050 to 1,300° C. for 1 to 24 hours while the oxygen concentration is controlled at 0.5 to 1.5% by volume to carry out sintering. In the case of crushing after calcination, the calcined material may be charged with water and crushed by a wet ball mill, wet vibration mill or the like.

To obtain the carrier core material according to the present invention, it is important to control the oxygen concentration of the sintering atmosphere to 0.5 to 1.5% by volume. Thus, rather than sintering in air, by sintering in an atmosphere having a controlled oxygen concentration, a core material having a desired resistivity can be obtained just as the basic composition, which allows the affects of sintering aids and the like to be excluded. Further, post-treatment resistivity adjustment is unnecessary, and there is no need to undergo superfluous steps. As a result, this is also advantageous in terms of costs. In the above-described conventional technology, the sintering is usually carried out in air.

Thus, since sintering is carried out in an atmosphere having a relatively low oxygen concentration, oxygen tends to be lacking in the crystal structure interior. As a result, after the sintering, the resultant product contains magnetite crystal structures which are partially substituted with Mn. By having such crystal structures, unlike Li ferrites representative of sintering in air, not only does resistivity tend to decrease, but by controlling the oxygen concentration during sintering, the level of magnetite crystal structures which are partially substituted with Mn can also be controlled.

Further, by controlling the oxygen concentration during sintering, magnetization and resistivity can be controlled just by setting the added amounts of Li and Mn as is. Especially, as can be understood from the chemical formula ($Li_{0.5}Fe_{2.5}O_4$) representing the composition of Li ferrite, compared with typical ferrites which are composed of di- or trivalent metal oxides, Li ferrites contain a large amount of iron. As a result, by mildly shifting the balance between divalent and trivalent iron from the chemical stoichiometric ratio by changing the oxygen concentration during sintering, the resistivity and magnetization can be controlled according to the application without changing the composition ratio itself of the metal elements.

The sintered material obtained by sintering in this manner is crushed and classified. The carrier core material is obtained by adjusting the particles to a desired size using a conventionally-known classification method, such as air classification, mesh filtration and precipitation.

Next, the resin is coated on the surface of the obtained carrier core material. The method for coating the resin is typically carried out by diluting the resin in a solvent, and then coating the resultant solution on the surface of the carrier core material. The coated amount and kind of the resin is as described above. Examples of the solvent which may be used here include, for resins which are soluble in organic solvents, toluene, xylene, cellosolve butyl acetate, methyl ethyl ketone, methyl isobutyl ketone, and methanol. For water-soluble resins or emulsion resins, water may be used. A conventionally-known method may be used to coat the coated resin such as that described above onto the above-described carrier core material. Examples of such coating methods include brush coating, dry method, spray-dry method using a fluidized bed, rotary-dry method and liquid immersion-dry method using a universal stirrer. To improve the coating efficiency, a method using a fluidized bed is preferable.

After the carrier core material has been coated with a resin, baking may be carried out by either external heating or internal heating. The baking can be carried out using, for example, a fixed-type or flow-type electric furnace, rotary electric furnace, burner furnace, or even by using microwaves. Although the baking temperature depends on the resin which is used, the temperature must be equal to or higher than the melting point or the glass transition point. For a thermosetting resin or a condensation-crosslinking resin, the temperature must be increased to a point where sufficient curing proceeds.

The resin-coated carrier according to the present invention is thus obtained by coating the resin on the carrier core material surface, and then baking, cooling, crushing, and carrying out particle size adjustment.

(Charge Amount Measurement)

3 g of commercially available toners (negatively charged and positively charged) and 47 g of the carrier were weighed and placed in a 50 mL glass bottle. This mixture was then mixed and stirred with a ball mill while matching the rotation number of the glass bottle to 100 revolutions. The respective developers were sampled 1 minute, 5 minutes, and 30 minutes after the start of stirring to measure the charge amount with the blow-off charge amount measurement apparatus TB-200 manufactured by Toshiba Chemical Corporation.

<Electrophotographic Developer According to the Present Invention>

Next, the electrophotographic developer according to the present invention will be described.

The electrophotographic developer according to the present invention is composed of the above-described carrier for an electrophotographic developer and a toner.

Examples of the toner particles constituting the electrophotographic developer according to the present invention include pulverized toner particles produced by a pulverizing method, and polymerized toner particles produced by a polymerizing method. In the present invention, toner particles obtained by either method can be used.

The pulverized toner particles can be obtained, for example, by thoroughly mixing a binding resin, a charge control agent and a colorant by a mixer such as a Henschel mixer, then melting and kneading with a twin screw extruder or the like, cooling, pulverizing, classifying, adding with additives and then mixing with a mixer or the like.

The binding resin constituting the pulverized toner particle is not especially limited, and examples thereof include polystyrene, chloropolystyrene, styrene-chlorostyrene copolymer, styrene-acrylate copolymer and styrene-methacrylate copolymer, as well as a rosin-modified maleic acid resin, epoxide resin, polyester resin and polyurethane resin. These may be used alone or by being mixed together.

The used charge control agent can be arbitrarily selected. Examples of a positively-charged toner include a nigrosin dye and a quaternary ammonium salt, and examples of a negatively-charged toner include a metal-containing monoazo dye.

As the colorant (coloring material), conventionally known dyes and pigments can be used. Examples include carbon black, phthalocyanine blue, permanent red, chrome yellow, phthalocyanine green. In addition, additives such as a silica powder and titania for improving the fluidity and cohesion resistivity of the toner can be added according to the toner particles.

Polymerized toner particles are produced by a conventionally known method such as suspension polymerization, emulsion polymerization, emulsion coagulation, ester extension polymerization and phase transition emulsion. The polymerization method toner particles can be obtained, for example, by mixing and stirring a colored dispersion liquid in which a colorant is dispersed in water using a surfactant, a polymerizable monomer, a surfactant and a polymerization initiator in an aqueous medium, emulsifying and dispersing the polymerizable monomer in the aqueous medium, and polymerizing while stirring and mixing. Then, the polymerized dispersion is charged with a salting-out agent, and the polymerized particles are salted out. The particles obtained by the salting-out are filtrated, washed and dried to obtain the polymerized toner particles. Subsequently, an additive may optionally be added to the dried toner particles to provide functions.

Further, during the production of the polymerized toner particles, a fixation improving agent and a charge control agent can be blended in addition to the polymerizable monomer, surfactant, polymerization initiator and colorant, thereby allowing the various properties of the polymerized toner particles to be controlled and improved. A chain-transfer agent can also be used to improve the dispersibility of the polymerizable monomer in the aqueous medium and to adjust the molecular weight of the obtained polymer.

The polymerizable monomer used in the production of the above-described polymerized toner particles is not especially limited, and examples thereof include styrene and its derivatives, ethylenic unsaturated monoolefins such as ethylene and propylene, halogenated vinyls such as vinyl chloride, vinyl esters such as vinyl acetate, and $\alpha$-methylene fatly monocarboxylates, such as methyl acrylate, ethyl acrylate, methyl methacrylate, ethyl methacrylate, 2-ethylhexyl methacrylate, dimethylamino acrylate and diethylamino methacrylate.

As the colorant (coloring material) used for preparing the above polymerized toner particles, conventionally known dyes and pigments are usable. Examples include carbon black, phthalocyanine blue, permanent red, chrome yellow and phthalocyanine green. The surface of colorants may be improved by using a silane coupling agent, a titanium coupling agent and the like.

As the surfactant used for the production of the above polymerized toner particle, an anionic surfactant, a cationic surfactant, an amphoteric surfactant and a nonionic surfactant can be used.

Here, examples of anionic surfactants include sodium oleate, a fatty acid salt such as castor oil, an alkyl sulfate such as sodium lauryl sulfate and ammonium lauryl sulfate, an alkylbenzene sulfonate such as sodium dodecylbenzene sulfonate, an alkylnaphthalene sulfonate, an alkylphosphate, a naphthalenesulfonic acid-formalin condensate and a polyoxyethylene alkyl sulfate. Examples of nonionic surfactants include a polyoxyethylene alkyl ether, a polyoxyethylene fatly acid ester, a sorbitan fatly acid ester, a polyoxyethylene alkyl amine, glycerin, a fatly acid ester and an oxyethylene-oxypropylene block polymer. Further, examples of cationic surfactants include alkylamine salts such as laurylamine acetate, and quaternary ammonium salts such as lauryltrimethylammonium chloride and stearyltrimethylammonium chloride. In addition, examples of amphoteric surfactants include an aminocarbonate and an alkylamino acid.

A surfactant like the above can be generally used in an amount within the range of 0.01 to 10% by weight of the polymerizable monomer. Such a surfactant affects the dispersion stability of the monomer as well as the environmental dependency of the obtained polymerized toner particles. It is thus preferred to use the surfactant in an amount within the above range from the perspectives of ensuring dispersion stability of the monomer and reducing the environmental dependency of the polymerized toner particles.

For the production of the polymerized toner particles, a polymerization initiator is generally used. Examples of polymerization initiators include water-soluble polymerization initiators and oil-soluble polymerization initiators, and either of them can be used in the present invention. Examples of water-soluble polymerization initiators which can be used in the present invention include persulfate salts such as potassium persulfate and ammonium persulfate, and water-soluble peroxide compounds. Examples of oil-soluble polymerization initiator include azo compounds such as azobisisobutyronitrile, and oil-soluble peroxide compounds.

In the case where a chain-transfer agent is used in the present invention, examples of the chain-transfer agent include mercaptans such as octylmercaptan, dodecylmercaptan and tert-dodecylmercaptan and carbon tetrabromide.

Further, in the case where the polymerized toner particles used in the present invention contain a fixation improving agent, examples of such fixation improving agent include a natural wax such as carnauba wax, and an olefinic wax such as polypropylene and polyethylene.

In the case where the polymerized toner particles used in the present invention contain a charge control agent, the charge control agent which is used is not especially limited. Examples include a nigrosine dye, a quaternary ammonium salt, an organic metal complex and a metal-containing monoazo dye.

Examples of the additive used for improving the fluidity etc. of the polymerized toner particles include silica, titanium oxide, barium titanate, fluorine resin microparticles and acrylic resin microparticles. These can be used alone or in combination thereof.

Further, examples of the salting-out agent used for separating the polymerized particles from the aqueous medium include metal salts such as magnesium sulfate, aluminum sulfate, barium chloride, magnesium chloride, calcium chloride and sodium chloride.

The volume average particle size of the toner particles produced as above is in the range of 2 to 15 μm, and preferably in the range of 3 to 10 μm. Polymerized toner particles have higher uniformity than pulverized toner particles. If the toner particles are less than 2 μm, charging capability is reduced, whereby fogging and toner scattering tend to occur. If the toner particles are more than 15 μm, this becomes a factor in deteriorating image quality.

By mixing the thus-produced carrier with a toner, an electrophotographic developer can be obtained. The mixing ratio of the carrier to the toner, namely, the toner concentration, is preferably set to be 3 to 15% by weight. If the concentration is less than 3% by weight, a desired image density is hard to obtain. If the concentration is more than 15% by weight, toner scattering and fogging tend to occur.

The thus-prepared electrophotographic developer according to the present invention can be used in digital copying machines, printers, FAXs, printing presses and the like, which use a development system in which electrostatic latent images formed on a latent image holder having an organic photoconductor layer are reversal-developed by the magnetic brushes of a two-component developer having the toner and the carrier while impressing a bias electric field. The present developer can also be applied in full-color machines and the like which use an alternating electric field, which is a method that superimposes an AC bias on a DC bias, when the developing bias is applied from magnetic brushes to the electrostatic latent image side.

The present invention will now be described in more detail based on the following examples.

Example 1

76.7 mol of $Fe_2O_3$, 13.3 mol of $Li_2CO_3$, and 3.33 mol of $Mn_3O_4$ were weighed out so that the Fe, Li, and Mn were in a predetermined weight ratio. The resultant mixture was charged with water so that the mixture had a solid content of 50%. Further, a 20% lithium silicate aqueous solution in terms of $SiO_2$ was added so that the mixture contained 3,000 ppm of Si based on the solid content. The mixture was crushed using a bead mill. The crushed product was then preliminarily granulated using a spray dryer, and calcined in an air atmosphere at 1,000° C. The calcined product was further charged with water, a binder component, and a dispersant so that the solid content was 50%. The resultant mixture was crushed using a bead mill, and the crushed product was granulated using a spray dryer. The obtained granulated material was deashed in air at 650° C., and then the resultant product was sintered for 16 hours at 1,165° C. at an oxygen concentration of 1% by volume to obtain a sintered material. The resultant sintered product was crushed using a hammer crusher, classified, and subjected to magnetic separation to obtain a carrier core material having a volume average particle size of 34.4 μm.

Example 2

As shown in Table 1, a carrier core material having a volume average particle size of 35.1 μm was obtained in the same manner as in Example 1, except that 1.66 mol of $Mn_3O_4$ was used.

Example 3

As shown in Table 1, a carrier core material having a volume average particle size of 35.5 μm was obtained in the same manner as in Example 1, except that 5 mol of $Mn_3O_4$ was used.

Example 4

As shown in Table 1, a carrier core material having a volume average particle size of 34.7 μm was obtained in the same manner as in Example 1, except that 9.5 mol of $Li_2CO_3$ was used.

Example 5

As shown in Table 1, a carrier core material having a volume average particle size of 34.8 μm was obtained in the same manner as in Example 1, except that 26.6 mol of $Li_2CO_3$ was used.

Example 6

As shown in Table 1, a carrier core material having a volume average particle size of 35.7 μm was obtained in the same manner as in Example 1, except that the lithium silicate was added so that the Si content was 10,000 ppm.

Example 7

As shown in Table 1, a carrier core material having a volume average particle size of 34.0 μm was obtained in the same manner as in Example 1, except that the oxygen concentration during sintering was 0.5% by volume.

Example 8

As shown in Table 1, a carrier core material having a volume average particle size of 33.7 μm was obtained in the same manner as in Example 1, except that the oxygen concentration during sintering was 1.5% by volume.

Comparative Example 1

As shown in Table 1, a carrier core material having a volume average particle size of 34.5 μm was obtained in the same manner as in Example 1, except that the oxygen concentration during sintering was made a non-oxidizing atmosphere (0% by volume).

Comparative Example 2

As shown in Table 1, a carrier core material having a volume average particle size of 34.0 μm was obtained in the same manner as in Example 1, except that the oxygen concentration during sintering was 10% by volume.

Comparative Example 3

As shown in Table 1, a carrier core material having a volume average particle size of 34.0 μm was obtained in the same manner as in Example 1, except that the oxygen concentration during sintering was 14% by volume.

Comparative Example 4

As shown in Table 1, a carrier core material having a volume average particle size of 35.7 μm was obtained in the same manner as in Example 1, except that the oxygen concentration during sintering was that for air sintering (21% by volume).

Comparative Example 5

As shown in Table 1, a carrier core material having a volume average particle size of 34.8 μm was obtained in the same manner as in Example 1, except that $Li_2CO_3$ was not added.

Comparative Example 6

As shown in Table 1, a carrier core material having a volume average particle size of 33.9 μm was obtained in the same manner as in Example 1, except that 28.6 mol of $Li_2CO_3$ and 1.66 mol of $Mn_3O_4$ were used.

Comparative Example 7

As shown in Table 1, a carrier core material having a volume average particle size of 36.0 μm was obtained in the same manner as in Example 1, except that $Mn_3O_4$ was not added.

Comparative Example 8

As shown in Table 1, a carrier core material having a volume average particle size of 34.8 μm was obtained in the same manner as in Example 1, except that 9.5 mol of $Li_2CO_3$ and 6.67 mol of $Mn_3O_4$ were used.

Comparative Example 9

As shown in Table 1, a carrier core material having a volume average particle size of 35.2 μm was obtained in the same manner as in Example 1, except that the lithium silicate was not added, so that the Si content was 0 ppm.

Comparative Example 10

As shown in Table 1, a carrier core material having a volume average particle size of 35.6 μm was obtained in the same manner as in Example 1, except that the lithium silicate was added so that the Si content was 20,000 ppm.

Table 1 illustrates the raw material charged amounts, sintering conditions, chemical analysis (ICP), X-ray diffraction results of Examples 1 to 8 and Comparative Examples 1 to 10. Further, Table 2 shows the magnetic properties, 50 V resistivity and 1,000 V resistivity (6.5 mm gap), and powder properties (volume average particle size $D_{50}$, BET specific surface area, red fine powder formation, SF-1) of Examples 1 to 8 and Comparative Examples 1 to 10. In addition, FIG. 1 illustrates an enlarged X-ray diffraction chart of the (110), (210), and (211) vicinity of the carrier core material particles obtained in Example 1.

Example 9

A carrier core material having a volume average particle size of 56.27 μm was produced in the same manner as in Example 1, and was coated by a mixing stirrer with the acrylic resin LR-269 manufactured by Mitsubishi Rayon Co., Ltd., as the coated resin. The resin was weighed so that the resin solution at this stage was 1.5% by weight in terms of resin solid content based on the carrier core material. A resin solution was used to which toluene had been added so that the resin solid content was 10% by weight. After the resin was coated, to completely eliminate volatile components, the coated carrier core material was dried for 2 hours by a hot air dryer set at 145° C. to obtain a resin-coated carrier.

Example 10

A carrier core material having a volume average particle size of 56.27 μm was produced in the same manner as in Example 1, and was coated by a fluidized bed coater with a coated resin formed by adding the polyvinylidene fluoride resin Kynar #2500 manufactured by Arkema to the silicone resin KR-350 manufactured by Shin-Etsu Silicone Co., Ltd. The resin was weighed so that the silicone resin solution at this stage was 1.5% by weight in terms of resin solid content based on the carrier core material. A silicone resin solution was used to which toluene had been added so that the resin solid content was 10% by weight. Further, the polyvinylidene fluoride resin was weighed so that it was 10% by weight in terms of solid content of the silicone resin, and then charged into the resin solution. The resultant resin solution was dispersed for 3 minutes by the homogenizer Ultra-Turrax T-50 manufactured by IKA, and then used for coating. After the resin was coated, to completely eliminate volatile components, the coated carrier core material was dried for 3 hours by a hot air dryer set at 200° C. to obtain a resin-coated carrier.

The charge amounts (stirring times: 1 minute, 5 minutes, and 30 minutes) of Examples 9 and 10 and the resistivity (6.5 mm gap) were evaluated. The results are shown in Table 3.

TABLE 1

| | Raw Material Added Amount | | | | Sintering Conditions | | Chemical Analysis (ICP) | | | |
|---|---|---|---|---|---|---|---|---|---|---|
| | $Fe_2O_3$ (mol) | $Mn_3O_4$ (mol) | $Li_2CO_3$ (mol) | Si (ppm) | Sintering Temperature (° C.) | Sintering Atmosphere Oxygen Concentration: (vol %) | Fe (wt %) | Mn (wt %) | Li (wt %) | Si (ppm) |
| Example 1 | 76.7 | 3.33 | 13.3 | 3000 | 1165 | 1 | 63.84 | 4.09 | 1.17 | 2800 |
| Example 2 | 76.7 | 1.66 | 13.3 | 3000 | 1165 | 1 | 67.35 | 2.15 | 1.45 | 2900 |
| Example 3 | 76.7 | 5 | 13.3 | 3000 | 1165 | 1 | 60.7 | 5.84 | 1.31 | 2800 |
| Example 4 | 76.7 | 3.33 | 9.5 | 3000 | 1165 | 1 | 67.52 | 4.33 | 1.04 | 2600 |
| Example 5 | 76.7 | 3.33 | 26.6 | 3000 | 1165 | 1 | 53.63 | 3.44 | 2.31 | 2900 |
| Example 6 | 76.7 | 3.33 | 13.3 | 10000 | 1165 | 1 | 63.85 | 4.09 | 1.38 | 9600 |
| Example 7 | 76.7 | 3.33 | 13.3 | 3000 | 1165 | 0.5 | 63.36 | 4.4 | 1.25 | 2800 |
| Example 8 | 76.7 | 3.33 | 13.3 | 3000 | 1165 | 1.5 | 63.33 | 4.28 | 1.28 | 2900 |
| Comp. Ex. 1 | 76.7 | 3.33 | 13.3 | 3000 | 1165 | 0 | 64.93 | 4.29 | 1.19 | 2700 |
| Comp. Ex. 2 | 76.7 | 3.33 | 13.3 | 3000 | 1165 | 10 | 63.28 | 4.01 | 1.24 | 2800 |
| Comp. Ex. 3 | 76.7 | 3.33 | 13.3 | 3000 | 1165 | 14 | 59.98 | 3.84 | 1.13 | 2900 |
| Comp. Ex. 4 | 76.7 | 3.33 | 13.3 | 3000 | 1165 | 21 | 57.85 | 3.71 | 1.13 | 2600 |
| Comp. Ex. 5 | 76.7 | 3.33 | 0 | 3000 | 1165 | 1 | 78.88 | 5.05 | 0 | 2800 |
| Comp. Ex. 6 | 76.7 | 1.66 | 28.6 | 3000 | 1165 | 1 | 54.7 | 1.75 | 2.51 | 2900 |
| Comp. Ex. 7 | 76.7 | 0 | 13.3 | 3000 | 1165 | 1 | 71.22 | 0 | 1.41 | 2700 |
| Comp. Ex. 8 | 76.7 | 6.67 | 9.5 | 3000 | 1165 | 1 | 60.84 | 7.81 | 0.86 | 2800 |
| Comp. Ex. 9 | 76.7 | 3.33 | 13.3 | 0 | 1165 | 1 | 63.85 | 4.07 | 1.25 | 20 |
| Comp. Ex. 10 | 76.7 | 3.33 | 13.3 | 20000 | 1165 | 1 | 63.85 | 4.11 | 1.27 | 19100 |

| | X-ray Diffraction Measurement Results*1 | | | | |
|---|---|---|---|---|---|
| | Integrated strengths Ratio $\Sigma(I_{110}+I_{210}+I_{211})/I_{311}$ | Li-Ferrite Phase Presence | Maghemite Phase Presence | Magnetite Phase Presence | Manganese Oxide Phase Presence |
| Example 1 | 3.6 | ○ | ○ | ○ | X |
| Example 2 | 4.3 | ○ | ○ | ○ | X |
| Example 3 | 2.5 | ○ | ○ | ○ | X |
| Example 4 | 2.8 | ○ | ○ | ○ | X |
| Example 5 | 4.5 | ○ | ○ | ○ | X |
| Example 6 | 3.7 | ○ | ○ | ○ | X |
| Example 7 | 2.1 | ○ | Δ | ○ | X |
| Example 8 | 5.4 | ○ | ○ | Δ | X |
| Comp. Ex. 1 | 1.9 | ○ | X | ○ | X |
| Comp. Ex. 2 | 14.3 | ○ | ○ | X | X |
| Comp. Ex. 3 | 17.7 | ○ | ○ | X | X |
| Comp. Ex. 4 | 18.3 | ○ | ○ | X | X |
| Comp. Ex. 5 | 1.8 | X | Δ | ○ | X |
| Comp. Ex. 6 | 5.1 | ○ | ○ | X | X |
| Comp. Ex. 7 | 7.2 | ○ | ○ | ○ | X |
| Comp. Ex. 8 | 2.3 | ○ | Δ | ○ | X |
| Comp. Ex. 9 | 3.5 | ○ | ○ | ○ | X |
| Comp. Ex. 10 | 3.6 | ○ | ○ | ○ | X |

*1○: Peak attributable to the crystal structure clearly detected. X: Peak attributable to the crystal structure could not be detected. Δ: Peak attributable to the crystal structure barely detected.

TABLE 2

| | Magnetic Properties (B—H 3 kOe) | | | Resistivity (6.5 mm Gap) (Ω) | | Powder Properties | | | |
|---|---|---|---|---|---|---|---|---|---|
| | δs ($Am^2/kg$) | σr ($Am^2/kg$) | Hc (Oe) | 50 V $R_{500}$ | 1000 V $R_{1000}$ | Volume Average Particle Size $D_{50}$ (μm) | BET Specific Surface Area ($m^2/g$) | Red Fine Powder Formation | SF-1 |
| Example 1 | 68 | 1 | 10 | $1.7\times10^8$ | $1.1\times10^8$ | 34.4 | 0.1465 | No | 121 |
| Example 2 | 67 | 1 | 12 | $6.9\times10^8$ | $6.5\times10^8$ | 35.1 | 0.1876 | No | 125 |
| Example 3 | 68 | 1 | 10 | $2.7\times10^8$ | $2.5\times10^8$ | 35.5 | 0.1344 | No | 124 |
| Example 4 | 67 | 2 | 12 | $7.2\times10^7$ | $7.3\times10^7$ | 34.7 | 0.1805 | No | 127 |
| Example 5 | 68 | 1 | 10 | $4.8\times10^8$ | $4.6\times10^8$ | 34.8 | 0.1645 | No | 120 |
| Example 6 | 68 | 1 | 10 | $4.0\times10^8$ | $4.2\times10^8$ | 35.7 | 0.0789 | No | 129 |
| Example 7 | 70 | 1 | 10 | $5.8\times10^7$ | $2.6\times10^7$ | 34 | 0.0863 | No | 126 |
| Example 8 | 66 | 1 | 12 | $4.8\times10^8$ | $4.3\times10^8$ | 33.7 | 0.1908 | No | 125 |
| Comp. Ex. 1 | 73 | 1 | 12 | $2.2\times10^7$ | Unmeasurable | 34.5 | 0.1052 | No | 124 |
| Comp. Ex. 2 | 64 | 2 | 20 | $7.7\times10^8$ | $7.4\times10^8$ | 34 | 0.1334 | Yes | 128 |
| Comp. Ex. 3 | 65 | 3 | 32 | $5.0\times10^9$ | $1.8\times10^9$ | 34.1 | 0.1749 | Yes | 129 |
| Comp. Ex. 4 | 64 | 3 | 45 | $1.0\times10^{10}$ | $7.5\times10^9$ | 35.7 | 0.2108 | Yes | 127 |

TABLE 2-continued

| | Magnetic Properties (B—H 3 kOe) | | | Resistivity (6.5 mm Gap) (Ω) | | Powder Properties | | | |
|---|---|---|---|---|---|---|---|---|---|
| | δs ($Am^2/kg$) | σr ($Am^2/kg$) | Hc (Oe) | 50 V $R_{500}$ | 1000 V $R_{1000}$ | Volume Average Particle Size $D_{50}$ (μm) | BET Specific Surface Area ($m^2/g$) | Red Fine Powder Formation | SF-1 |
| Comp. Ex. 5 | 36 | 4 | 48 | $3.8 \times 10^6$ | Unmeasurable | 34.8 | 0.311 | No | 120 |
| Comp. Ex. 6 | 68 | 1 | 10 | $7.3 \times 10^9$ | $3.5 \times 10^9$ | 33.9 | 0.1512 | Yes | 131 |
| Comp. Ex. 7 | 47 | 3 | 36 | $8.3 \times 10^8$ | $6.1 \times 10^8$ | 36 | 0.2714 | No | 123 |
| Comp. Ex. 8 | 67 | 1 | 10 | $3.2 \times 10^8$ | $8.1 \times 10^7$ | 34.8 | 0.1641 | Yes | 124 |
| Comp. Ex. 9 | 68 | 1 | 10 | $8.8 \times 10^7$ | $6.3 \times 10^7$ | 35.2 | 0.2437 | No | 135 |
| Comp. Ex. 10 | 67 | 1 | 10 | $3.2 \times 10^9$ | $8.8 \times 10^8$ | 35.6 | 0.0715 | No | 147 |

TABLE 3

| | Toner | Charge Amount Measurement Results (μC/g) Stirring Time | | | Resistivity (6.5 mm Gap) (Ω) | |
|---|---|---|---|---|---|---|
| | Polarity | 1 min | 5 min | 30 min | 50 V | 1000 V |
| Example 9 | Negative Electric | −40.1 | −42.3 | −44.1 | $5.8 \times 10^{11}$ | $8.8 \times 10^{10}$ |
| Example 10 | Positive Electric | 19.3 | 25.5 | 28.2 | $3.7 \times 10^{11}$ | $2.1 \times 10^{10}$ |

It is clear from the results of Tables 1 and 2 that electrical resistivity in Examples 1 to 8 was roughly the same regardless of the applied voltage. Further, in Comparative Example 1 breakdown occurred during high-voltage application. In Comparative Examples 2 to 4, the oxygen concentration during sintering was high, so that the resistivity was increased. From the X-ray diffraction measurement results of the carrier core materials obtained in Examples 1 to 8 and Comparative Examples 1 to 10, it can be seen that integrated strengths ratio is a good selection method when selecting among magnetic properties and electrical properties. In Comparative Examples 2 to 4, 6, and 8, a red fine powder was formed. In Comparative Example 9, because Si was not added, sintering did not proceed, so that the specific surface area of the carrier core material was very large. In Comparative Example 10, because excess Si was added, the sintering proceeded too far, so that the specific surface area of the carrier core material was very small, and the shape was poor. Further, when all of the carrier core materials obtained in the examples and comparative examples were measured by X-ray diffraction, it was confirmed that any form of Mn oxides was not present. In addition, when all of the carrier core materials obtained in the examples and comparative examples were measured by X-ray diffraction, peaks of Mn compounds in raw material form and/or Mn oxides were not found. Therefore, it was determined that the Mn contained in the carrier core materials obtained in Examples 1 to 8, Comparative Examples 1 to 4, Comparative Example 6, and Comparative Examples 8 to 10 was substituted in part of the Li-ferrite, maghemite, and $Fe_3O_4$. Further, it was determined that the Mn contained in the carrier core material obtained in Comparative Example 5 was substituted in part of the maghemite and $Fe_3O_4$.

Further, in Examples 9 and 10, as shown in Table 3, it was confirmed that sufficient resistivity and charge properties as a carrier could be obtained even by coating with a resin.

Since, by using the carrier core material and carrier according to the present invention, there is no large change in resistivity from low bias to high bias when used as an electrophotographic developer, and magnetization can be easily controlled, carrier beads carry over does not occur, and a stable image density can be obtained.

Therefore, the carrier core material for an electrophotographic developer, the carrier, and the electrophotographic developer using such carrier according to the present invention can be widely used in fields such as full color machines, in which high quality images are demanded, and high-speed machines, in which the reliability and durability of image sustainability are demanded.

What is claimed is:

1. A carrier core material for an electrophotographic developer comprising Li ferrite, maghemite, and $Fe_3O_4$, wherein a part thereof is substituted with Mn, Li content is 1 to 2.5% by weight, Mn content is 2 to 7.5% by weight, and silicon content is 25 to 10,000 ppm, the following equation (1) is satisfied when respective integrated strengths of spinel crystal structure (110), (210), (211), and (311) faces in X-ray diffraction are respectively $I_{110}$, $I_{210}$, $I_{211}$, and $I_{311}$, a resistivity $R_{50}$ of 50 V across a 6.5 mm gap is $5\times10^7$ to $7\times10^8\Omega$, and a resistivity $R_{1000}$ of 1,000 V across a 6.5 mm gap is $1\times10^7$ to $8\times10^8\Omega$ $$2<100\times(I_{110}+I_{210}+I_{211})/I_{311}<14 \quad (1).$$

2. The carrier core material for an electrophotographic developer according to claim 1, wherein a BET specific surface area is 0.075 to 0.30 $m^2/g$.

3. The carrier core material for an electrophotographic developer according to claim 1, wherein magnetization at $3K\cdot1000/4\pi\cdot A/m$ is 40 to 71 $Am^2/kg$.

4. The carrier core material for an electrophotographic developer according to claim 1, wherein a volume average particle size is 20 to 100 μm.

5. A carrier for an electrophotographic developer, wherein the carrier core material according to claim 1 is coated with a resin.

6. The carrier for an electrophotographic developer according to claim 5, wherein the resin is one or more selected from the group consisting of a silicone resin, an acrylic-modified silicone resin, a fluorine-modified silicone resin, an acrylic resin, and a fluorine acrylic epoxy resin.

7. The carrier for an electrophotographic developer according to claim 5, comprising in the resin at least one inorganic microparticle selected from the group consisting of carbon black, a metal oxide, and a metal complex.

8. An electrophotographic developer comprising the carrier according to claim 5, and a toner.

* * * * *